US005725108A

United States Patent [19]

Olson

[11] Patent Number: 5,725,108

[45] Date of Patent: Mar. 10, 1998

[54] CUTTING BLOCK AND KNIFE SAVER

[75] Inventor: Nathan S. Olson, P.O. Box 120, Vienna, Mo. 65582

[73] Assignee: Nathan S. Olson, Vienna, Mo.

[21] Appl. No.: 762,542

[22] Filed: Dec. 9, 1996

[51] Int. Cl.[6] ..... A47F 7/00

[52] U.S. Cl. ..... 211/70.7; 248/37.3; 248/37.6

[58] Field of Search ..... 211/70.7, 86.01; 248/37.6, 37.3; 312/235.1

[56] References Cited

U.S. PATENT DOCUMENTS

| | | | |
|---|---|---|---|
| 2,845,323 | 7/1958 | Seibert, Jr. | 211/70.7 X |
| 3,677,400 | 7/1972 | Spier | 211/70.7 X |
| 3,926,419 | 12/1975 | Kenny | 248/37.6 X |
| 4,082,390 | 4/1978 | Gibson et al. | 312/244 X |
| 4,511,040 | 4/1985 | Tolentino | 248/37.6 X |
| 4,744,613 | 5/1988 | Brantingham et al. | 312/244 X |

*Primary Examiner*—Peter M. Cuomo
*Assistant Examiner*—David E. Allred

[57] ABSTRACT

A combination material cutting block presenting a surface to support material when being cut, legs to support the cutting block at a suitable elevation on a work surface, a second block sized to fit under the surface of the cutting block between the support legs, slots in the second block to retain a set of cutting knives with the blades out of contact from prying fingers and with the handles held for easy withdrawal, and hold down elements between the blocks in position to hold the knife handles in position when the cutting block is placed over the second block.

6 Claims, 1 Drawing Sheet

CUTTING BLOCK AND KNIFE SAVER

BACKGROUND OF THE INVENTION

This invention relates to a cutting block with mounting means for storing knives.

It is believed that the prior art does not disclose the cutting block and knife saver combined in a mounting for the knives so the block and the knives are readily interrelated so as to remain in a combined assembly for use as needed.

BRIEF SUMMARY OF THE INVENTION

This invention is concerned with the safe mounting of cutting block knife to overcome the too easy access of the knives employed for cutting blocks in relation to households with children.

Furthermore, the cutting block with knife saver places a knife holder in position to keep the knives in full view at all times.

Still further, the invention provides a cutting block and a knife carrier in which the knife blades are in full view but with no cutting edge accessible no matter how a person sticks a finger in the place where the knives are stored.

Yet another object of the invention is to relate the cutting block and one or more knives in such a way that when the cutter block and a knife carrier are assembled rough treatment will not dislodge the knives.

A further object is to provide a latching connection between the cutting block and one or more knives so that when not in use the knives are secured.

It is also an object of the invention to provide both a cutting block and a carrier for assorted knives which are moisture insensitive for sanitary stability.

BRIEF DESCRIPTION OF THE SEVERAL VIEWS OF THE DRAWINGS

The cutting block and knife carrier is seen in its presently preferred embodiment in the following drawings, wherein.

DETAILED DESCRIPTION OF THE INVENTION

Figure 1:
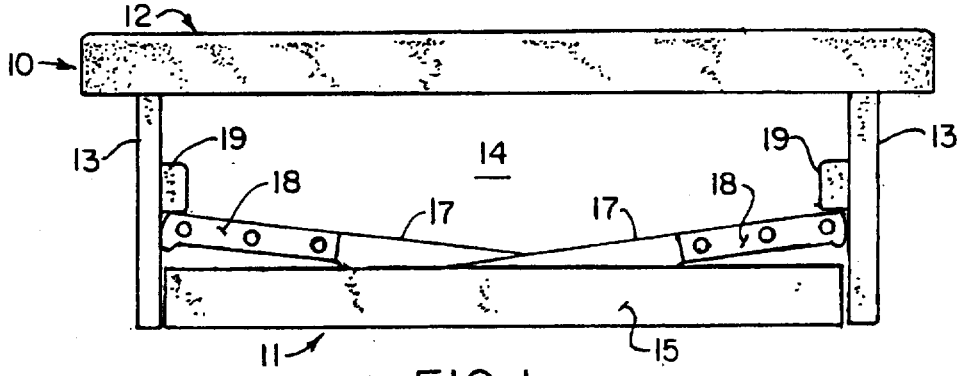
FIG. 1 is a longitudinal side elevation of the cutting block assembled with a carrier for knives.
Figure 2:
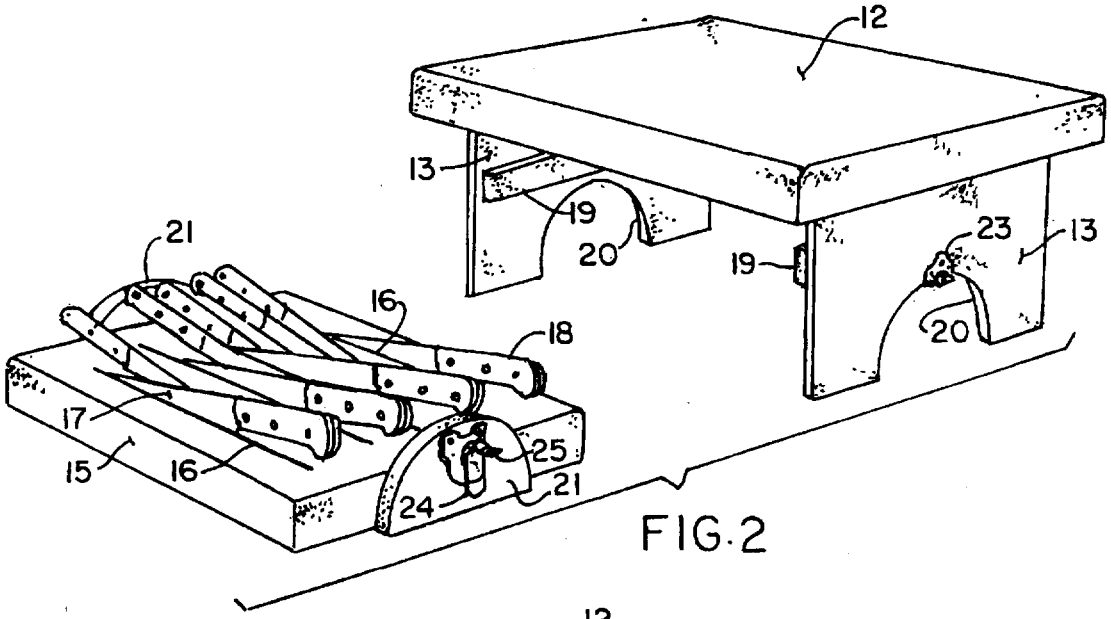
FIG. 2 is a disassembled perspective view of the components making up the invention.
Figure 3:
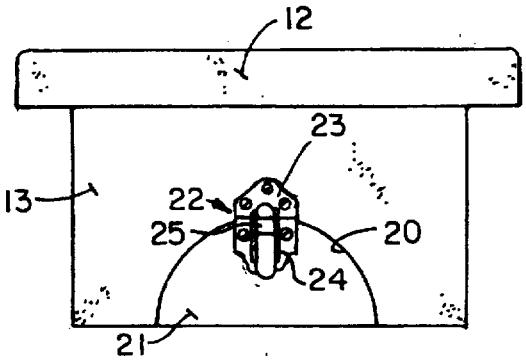
FIG. 3 is a vertical end view to illustrate a latch assembly for the retention of the components.

FIG. 1 is a view in side elevation of a cutting block 10 equipped with a knife carrier 11 to complete a typical assembly. The block 10 is formed of suitable material which is moisture stable and can be of hard wood, or inert material shaped in the form of a rectangular block 12. While hard wood is relatively inexpensive, a more durable material may be molded of acrylic material having a suitable filler material which can add color if desired as well as rendering the acrylic material inert safe for the cutting of food. A suitable block material can be formed from DuPont "CORIAN" available from Art Specialties in Depew, N.Y.

The cutting block is supported on legs 13 near its opposite lengthwise ends. The legs provide a suitable under the block 12 space 14 to receive a knife carrier block 15. In this case, the carrier may be cut from suitable wood material or molded from the CORIAN acrylic material in which slots 16 can be provided. The slots may have desired sizes to retain knife blades 17 with the handles 18 exposed for easy withdrawal.

A feature of retaining the knives in a safe mounting is to insert the cutting blades 17 with the cutting edges in the respective slots 16. Still further, the block 15 with the knives inserted in the slots 16 can be placed under the cutting block 12 between the legs 13 so the angularly exposed knife handles 18 are fitted under hold down ribs 19 fixed to the inside surfaces of the legs, as clearly seen in FIG. 1.

Not only are the knife handles held down under the ribs 19, but the support legs 13 are each formed with circular cut-outs 20 to receive similarly shaped plugs 21 in the respective cut-outs 20. In order to obtain the secure assembly of the knife block 15 it is obtained by positioning the cutting block 12 over the block 15 so the plugs 21 seat in the cut-outs 20. Thus, the blocks 12, legs 13 and block 16 form a new assembly to house the knives.

Assembly of the blocks 12 and 15 can be locked in assembly by suitable trunk lock devices 22 in which a retainer element 23 secured to the legs 13 can be releasably engaged by lifting a hasp 24 to drop over the retainer element 23. Thereafter a tensioning element 25 can be closed to put holding tension on the hasp. When so locked into the assembly position as in FIG. 1, the entire assembly is rendered portable so it can be placed in a storage cupboard so as to be out of the way.

While an insensitive and moisture resistant material like CORIAN can be used in the manufacture of the assembly, it is equally adaptable to form the cutting block 12 from walnut or oak or similar hard woods. The knife block is easily adaptable to many different cutting knives provided the selection will be suitable to fit into the secured positions seen in FIG. 1.

One skilled in the art will recognize the advantages taught by this invention and illustrated by the preferred embodiment presented. The specification and drawings are not intended to represent an exhaustive description of the invention. Obvious applications and extensions of the invention are intended to be within the spirit and scope of this invention.

I claim:

1. A cutting block and cutting knife saver combination comprising:

a) a cutting block having a work cutting surface supported on spaced apart legs;

b) a knife saver block sized to fit between said spaced legs;

c) knife handle and blade supporting slots in said knife saver block to protect knife cutting edges;

d) locating means on said cutting block and knife saver block having an interfitting engagement with said blocks in stacked relation; and wherein hold down elements on said legs are engaged by knife handles to retain said knife blades in said slots whenin said stacked relation.

2. The combination set forth in claim 1 wherein releasable locking means on said locating means is located to retain said interfitting engagement between said blocks.

3. The combination set forth in claim 1 wherein said cutting block is formed from an inert material resistant to moisture.

4. The combination set forth in claim 2 wherein said releasable locking means on said locating means retains said blocks as a portable assembly in said interfitted engagement.

5. The combination set forth in claim 1 wherein said locating means on said cutting block is formed with a shaped opening in said legs and said knife saver block is formed with a shaped projection to have an interfitting shape substantially matching said shaped opening in said legs.

6. A cutting block and a knife carrying block combination comprising:

a) a knife carrying block having a surface formed with knife blade slots to carry knives with said blades in said slots;

b) a cutting block having a material cutting surface and spaced support legs under said cutting surface in position to embrace said knife carrying block;

c) locking means on said spaced legs and on said knife carrying block releasably retaining said cutting block embracing said knife carrying block; and wherein said knife blades have handles exposed at said knife blade slots, and said cutting block legs have elements retaining said knife handles on said knife carrying block with said securing means in releasable retention holding said blocks in an embraced position.

* * * * *